US010106232B2

(12) United States Patent
Codda et al.

(10) Patent No.: US 10,106,232 B2
(45) Date of Patent: Oct. 23, 2018

(54) FASTENING ASSEMBLY OF A FIRE DOOR TO A BULKHEAD

(71) Applicant: CENTRO PER GLI STUDI DI TECNICA NAVALE-CETENA S.p.A., Genoa (IT)

(72) Inventors: Matteo Codda, Genoa (IT); Andrea Pullara, Genoa (IT); Francesco Cestineto, Genoa (IT)

(73) Assignee: CENTRO PER GLI STUDI DI TECNICA NAVALE-CETENA S.p.A., Genoa (IT)

( * ) Notice: Subject to any disclaimer, the term of this patent is extended or adjusted under 35 U.S.C. 154(b) by 0 days.

(21) Appl. No.: 15/525,872

(22) PCT Filed: Nov. 11, 2015

(86) PCT No.: PCT/IB2015/058703
§ 371 (c)(1),
(2) Date: May 10, 2017

(87) PCT Pub. No.: WO2016/075629
PCT Pub. Date: May 19, 2016

(65) Prior Publication Data

US 2018/0148142 A1 May 31, 2018

(30) Foreign Application Priority Data

Nov. 12, 2014 (IT) ..... MI2014A1952

(51) Int. Cl.
*B63B 43/24* (2006.01)
*B63B 3/56* (2006.01)
(Continued)

(52) U.S. Cl.
CPC ..... *B63B 43/24* (2013.01); *B63B 3/56* (2013.01); *E06B 1/18* (2013.01); *E06B 5/00* (2013.01)

(58) Field of Classification Search
CPC .... B63B 3/56; B63B 3/58; B63B 3/60; B63B 43/24; B63B 43/26; B63B 43/28;
(Continued)

(56) References Cited

U.S. PATENT DOCUMENTS 3,596,405 A * 8/1971 Ingulf ..... E06B 1/18 49/504
4,128,977 A * 12/1978 Schubeis ..... E06B 1/20 52/212

FOREIGN PATENT DOCUMENTS

CN 201419786 3/2010
EP 1 818 495 A1 8/2007
(Continued)

OTHER PUBLICATIONS

International Search Report and Written Opinion of the International Searching Authority for corresponding International Patent Application No. PCT/IB2015/058703 dated Jan. 27, 2016, 9 pgs.

*Primary Examiner* — Ajay Vasudeva
(74) *Attorney, Agent, or Firm* — Merchant & Gould P.C.

(57) ABSTRACT

A fastening assembly of a fire door to a bulkhead includes a shaped frame, to which is hinged the door, which includes a first bracket facing at least in part a first side surface of the bulkhead, and a primary flange, mechanically connected to the first bracket. The fastening assembly has a subframe, which in turn includes a second bracket, parallel to the first bracket and facing a second side surface of the bulkhead, and at least one secondary flange, mechanically connected to the second bracket. At least one joint mutually connects the frame and the subframe, to retain the bulkhead between the first and the second bracket mutually facing, without engag-
(Continued)

ing simultaneously the bulkhead the portion of the first bracket facing the first side surface and the portion of the second bracket facing the second side surface.

21 Claims, 10 Drawing Sheets

(51) Int. Cl.
*E06B 1/18* (2006.01)
*E06B 5/00* (2006.01)

(58) Field of Classification Search
CPC . B63B 43/30; B63B 43/32; E06B 1/18; E06B 1/20; E06B 1/32; E06B 1/325; E06B 1/52; E06B 1/526; E06B 1/60; E06B 1/6007; E06B 5/00; E06B 5/16; E06B 5/168
See application file for complete search history.

(56) References Cited

FOREIGN PATENT DOCUMENTS

| | | | |
|---|---|---|---|
| KR | 2004-0045075 | A | 6/2004 |
| KR | 2012-0010772 | A | 2/2012 |

* cited by examiner

FASTENING ASSEMBLY OF A FIRE DOOR TO A BULKHEAD

This application is a National Stage Application of PCT/IB2015/058703, filed 11 Nov. 2015, which claims benefit of Serial No. MI2014A001952, filed 12 Nov. 2014 in Italy and which applications are incorporated herein by reference. To the extent appropriate, a claim of priority is made to each of the above disclosed applications.

TECHNICAL FIELD

The present invention pertains, in general, to the field of fastening assemblies of a door to a fixed support; in particular, the invention relates to a fastening assembly of a fire door, in particular to be used in the naval field.

PRIOR ART

Fire doors conventionally adopted in shipbuilding are connected by means of a weld joint or bolted joint with through screws on the ship bulkhead.

An example of a solution to secure a door to a bulkhead, of the type just described, can be found in KR20040045075A.

More specifically, in the prior art use is made of a connecting weld joint between the steel frame of the door and the steel bulkhead of the ship or, alternatively, of bolted joints which rigidly constrain the frame to the bulkhead connected thereto.

In both cases, as the ship subjected to wave load is in operation, the door frame is inevitably stressed, since it is rigidly connected to the bulkhead.

Moreover, the prior solutions have criticalities in the mounting process, which requires a large use of labor and time, needed for the installation of the door.

Such criticalities are added to the aforementioned problems related to the operation of the ship, since the rigidity of the conventional connecting joints causes the stresses resulting from the global loads of the ship to be transmitted to the door frame, thus compromising the functions thereof and/or initiating fatigue cracks on the frame (with consequent reduction of the device life).

For example, given the need to manually obtain the housing compartment of the door in the bulkhead, the profile of the opening thus achieved will appear uneven, thus causing difficulties in the welding between the frame and the bulkhead, unless not to carry out the trimming of such a profile.

In order to obviate some of the above-mentioned drawbacks, in the state of the art it has also been suggested to place the door and the bulkhead on staggered planes, connecting the two elements by means of an L-shaped structure welded to the bulkhead in a cantilever manner; by doing so, the need also disappears to provide fittings in the corners of the frame intended to receive the door, which may therefore be made with a sharp edge. In fact, as it can be seen in FIGS. 4 and 5, the wave load transmits a stress to the vessel structure, which stress becomes critical in C areas tending to thicken in the vicinity of the door compartments; in order to avoid the occurrence of cracks and other fatigue phenomena, due to the localized concentration of the tensions transmitted from the bulkhead to the frame, the corners of the compartments are fitted along radiuses of curvature which make the installation of the door on a plane coplanar to the bulkhead plane uncomfortable.

In addition, the door and the support frame thereof may be previously mounted on the structure, so that the preassembled assembly can be simply transferred on board of the vessel and here constrained to the bulkhead by means of welding.

Making use of the bolted joint allows the problem of the uneven profile of the bulkhead edge to be overcome, otherwise intended to be welded to the support frame of the door leaf. Moreover, in the prior art the possibility of tightening said bulkhead between the frame and a subframe connected to each other by means of a plurality of additional joining elements arranged in a direction perpendicular to the bulkhead is contemplated, the frame engaging a face of the bulkhead and the subframe the opposite face (as shown in FIG. 7). Because the frame and the subframe clasp the bulkhead acting on both faces and not on the single edge of the compartment, any imperfections or corrugations of the profile to be welded and/or flatness defects of the bulkhead do not affect the effectiveness of the constraint. Moreover, it is preferred to tighten the bulkhead bilaterally in a sandwiched fashion by means of the frame and the subframe for an optimal resistance to water.

Such a configuration allows a further advantage to be achieved, since the constraint made by the additional joining elements allows the number of tightening elements passing through the bulkhead to be decreased, thereby making the on-board installation of the article less difficult.

However, a thus configured connection still makes a rigid constraint between the frame-subframe assembly and the bulkhead, due to the tightening action exerted thereon by the bolted joint; therefore, such a solution suffers from the problems related to the excessive stress on the frame due to the wave load transmitted by the bulkhead.

Moreover, as the deformability of the wing of the fire door is highly greater than the deformability of the frame (rigidly constrained to the bulkhead and/or to the subframe), the wing will tend to open up with respect to the frame, thus creating a passageway for heat and fumes.

SUMMARY OF THE INVENTION

It is an object of the present invention to obviate the limitations of the prior art, by providing a connection between a fire door and a bulkhead, in particular in the nautical/naval field, which allows the frame to be protected from excessive and repeated stresses which can initiate cracks or deformation and/or compromise the functions of the safety device, even improving the fireproof capacity.

It is a further object of the present invention to simplify the operation of mounting the door to the bulkhead, thus minimizing the number and difficulty of the operations to be carried out for the installation.

In order to achieve such results, the frame and the subframe are connected to each other, according to an embodiment of the invention, by means of a bolted joint, with screws arranged in a direction parallel to the bulkhead: thereby, the frame and the subframe are not subjected to a tightening force on the bulkhead, but only to the maintenance of a mutual distance between two facing brackets (integral with the frame and the subframe, respectively), in order to allow the facing frame and subframe to receive the bulkhead within such brackets, possibly preserving a certain clearance.

Therefore, as the constraint between the frame and the bulkhead is not rigid, but shaped so as to allow relative displacements between the two parts, the stresses on the frame will not be such as to cause deformations or fatigue damages. In fact, while in the prior art the bulkhead, in addition to being connected to the frame by means of through screws therethrough, is gripped between the frame and the subframe with a force related to the tightening of the joint, so as to generate a high friction between the parts which stiffens the constraint and causes strong stresses on the frame, in the present invention the bulkhead and the frame are only subjected to a location constraint, thus minimizing the friction exchanged between the two elements.

The lability degree introduced in the constraint by the decoupling between the frame and the bulkhead allows, with respect to the prior art, jamming phenomena of the door to be avoided, which phenomena are due to the deformation transmitted from the bulkhead to the frame; thereby, the risk disappears that the door is stuck in the frame, as a result of an excessive deformation of the bulkhead due, for example, to the wave load, or on the contrary that the door does not enter in the frame, thus preventing the fire device from being correctly closed. It is apparent that, especially in case of emergency, the operation of the fastening assembly, according to the present invention, as a passive anti-locking safety device of the doors ensures a significant advantage over the known solutions.

In addition, due to the mechanical decoupling between the frame and the bulkhead, being the deformation from the bulkhead and transmitted to the frame (generated due to the global ship loads) minimized, the use of constructionally lighter and simpler, therefore less costly, frames is made possible.

In fact, the frame must be sized to resist only to local loads related to the functions of the door and not to withstand the stresses resulting from the deformations generated by the bulkhead, as it occurs instead in the solutions of the prior art (in which the frame, being rigidly constrained to the bulkhead, becomes a structural element of the vessel).

Moreover, with a fastening assembly of the door to the bulkhead according to the present invention, there is no need to join the frame and the subframe in a high number of points (to give the constraint an adequate tightening). Instead, few joining points may be provided, since the frame-subframe assembly is not rigidly connected to the bulkhead, and does not undergo particularly dangerous stresses: therefore, it is sufficient to ensure a minimum connection strength between the aforesaid elements, in order to ensure the maintenance of the predetermined distance between the facing brackets which receive the bulkhead.

The possibility of reducing the number of joining points, as well as the absence of holes to be drilled on the bulkhead to allow the fastening of the frame, allow the cost and time of installation of the door to be lowered significantly.

A further advantage, achievable by the aforesaid feature, consists in that, when the door must withstand a fire condition, the frame, not being rigidly connected to the bulkhead, is free to deform, going along and following the deformation of the wing: thereby, the gap which would be created between the wing and the frame is canceled or significantly reduced, and the fire device retains its efficiency and resistance to heat and fumes (as seen in FIG. 15). The gasket ensures the resistance even where the detachment between the frame and the bulkhead occurs. Therefore, the wing is made of a malleable material, which deforms under the action of heat, though ensuring a sufficient fire resistance.

FIG. 16 shows a comparative graph between the gap which is created between a traditional wing-frame assembly and an assembly according to the invention, when exposed to a heat source which hits them from one side: the graph highlights how, in the traditional assembly (which is associated with the upper curve), the relative deviation between the wing and the frame is significantly higher than that of the assembly according to the invention (which is associated with the lower curve), generating a wide gap between the components of the assembly, which affects the resistance of the fire device.

BRIEF DESCRIPTION OF THE DRAWINGS

The operational and structural features of some preferred embodiments of a fastening assembly according to the invention will now be described. Reference is made to the accompanying drawings, in which.

DETAILED DESCRIPTION

Figure 1:
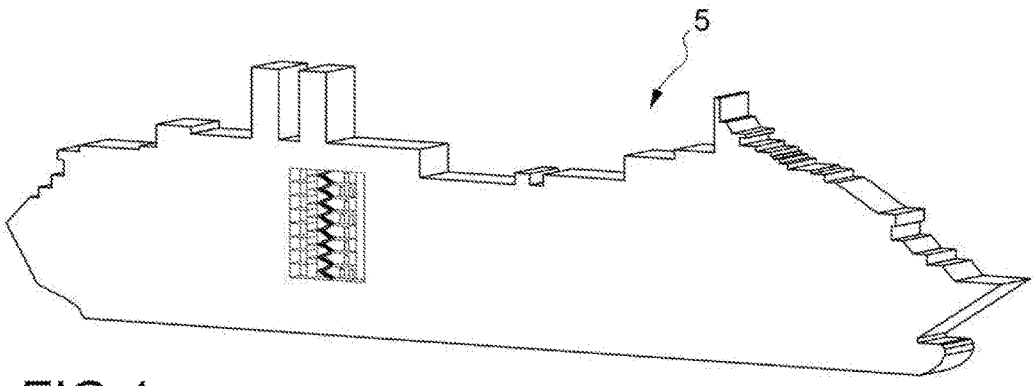
FIGS. 1 and 2 are diagrammatic perspective views in partial longitudinal section of a vessel and of a detail of the vessel in FIG. 1, respectively.

Before explaining in detail a plurality of embodiments of the invention, it should be clear that the invention is not limited in the application thereof to the constructional details and to the configuration of the components disclosed in the following description or shown in the drawings.

Figure 2:
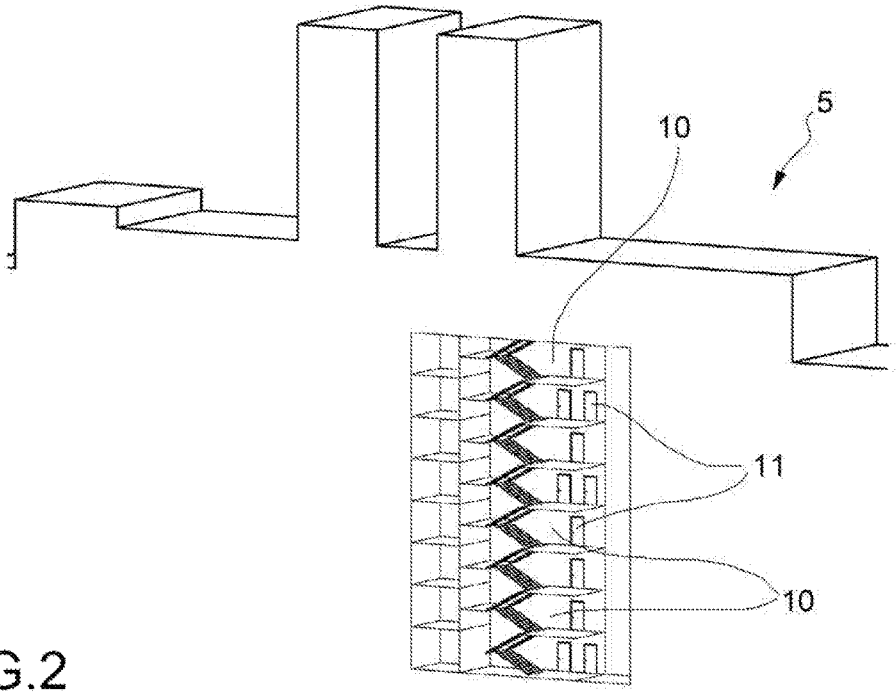
Figure 3:
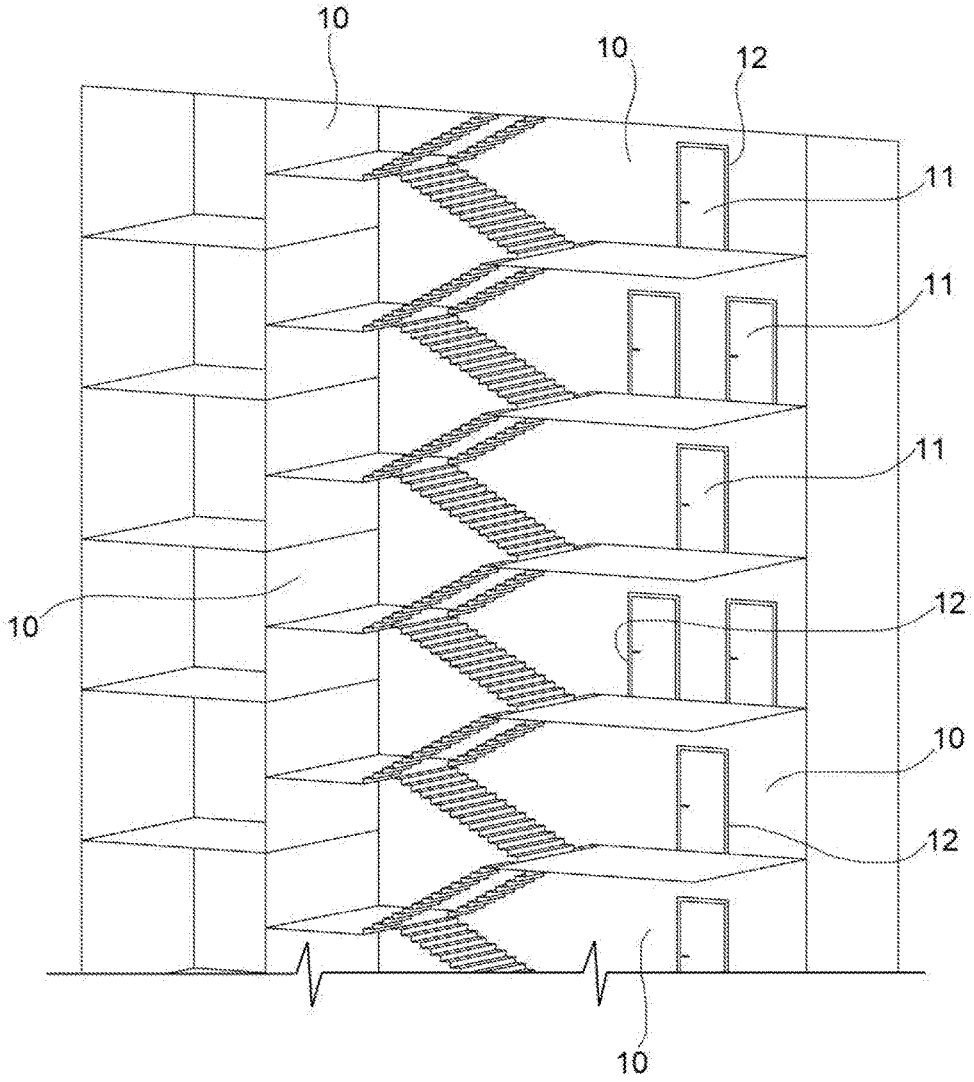
FIG. 3 is a diagrammatic view of a detail of FIG. 2, which shows a plurality of bulkheads on which a plurality of doors is mounted, according to the prior art.
Figure 4:
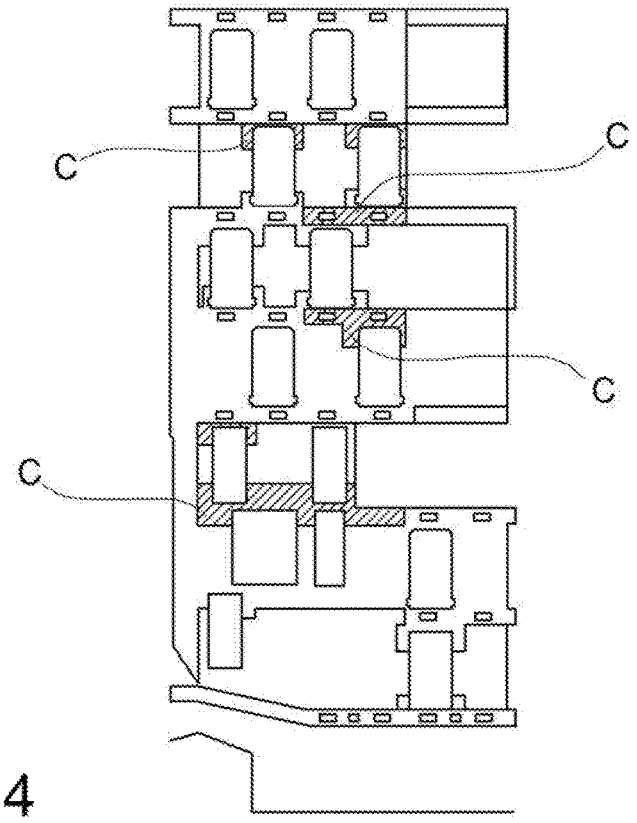
FIGS. 4 and 5 are stress diagrams of a vertical section of the hull of a vessel and of the vicinity of the compartment of a door, respectively, when the vessel is subjected to the wave load.

Referring first to FIGS. 1 and 2, a vessel 5 has a plurality of bulkheads 10, on which openings adapted to receive fire doors 11 may be obtained, connected to the bulkheads by means of frames 12 (seen in FIG. 3).

Figure 6:
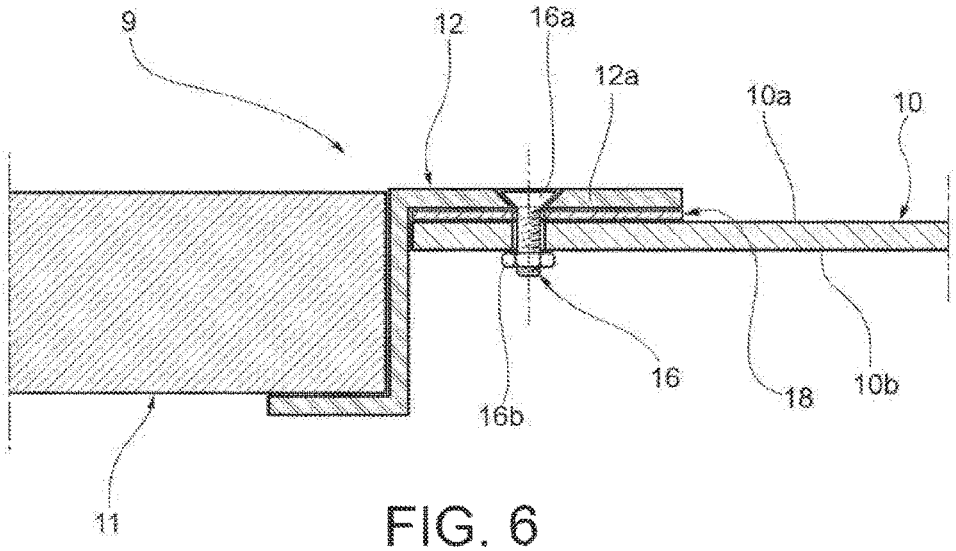
FIG. 6 (Prior Art)
FIGS. 6 and 7 are diagrammatic cross-sectional views of two fastening assemblies of a door to a bulkhead, according to the prior art.
Figure 7:
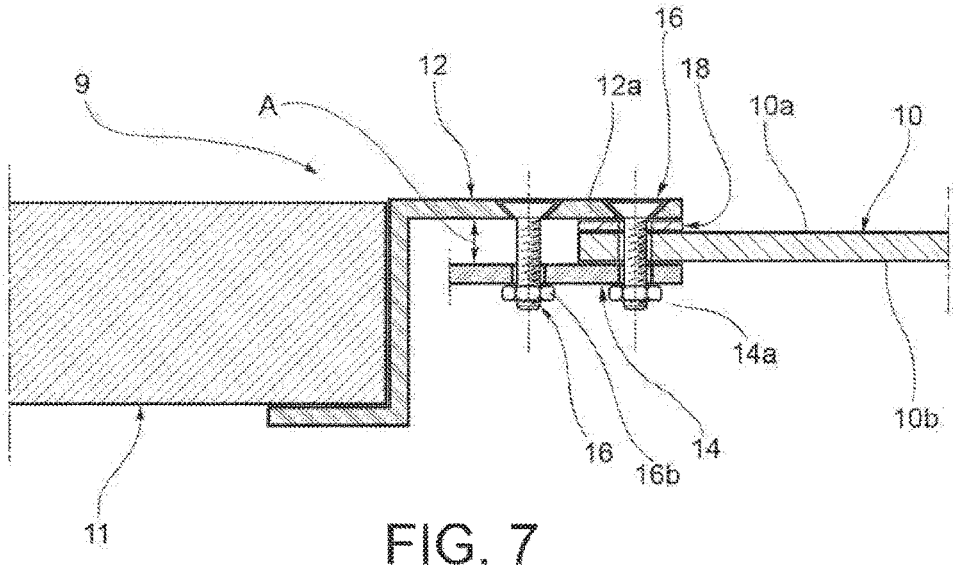
FIG. 7 (Prior Art)

Referring then to FIGS. 6 and 7, concerning two fastening solutions of the fire door 11 to the bulkhead 10 according to the prior art, frame 12 is an extruded metal element which has a bracket 12*a* parallel to said bulkhead 10. Frame 12, to which the door or leaf or wing 11 is hinged, is rigidly constrained to the bulkhead by means of a certain number of joints 16. Such joints may be of the bolt type, or may be in the form of a spot or continuous weld. Wing 11 is made of a malleable material which has a sufficient fire resistance; the wing or fire door 11 is preferably made of a material which has a yield stress greater than or equal to 230 MPa; preferably, S235, S275 or S355 structural steel may be used.

In FIG. 6, the frame is directly constrained to bulkhead 10 by means of bolted joints 16 passing through said bulkhead 10; in the example in FIG. 7, instead, the constraint made by the bolted joints 16, passing through bulkhead 10, is reinforced thus forcing said bulkhead 10 between the first bracket 12*a* of frame 12, and a second bracket 14*a* of a subframe 14. The second bracket 14*a* is parallel to both the first bracket 12*a* and the bulkhead 10, and is connected to the first bracket 12*a* by means of additional bolted joints arranged in a direction perpendicular to bulkhead 10. Therefore, the first bracket 12*a* will face a first side surface 10*a* of bulkhead 10, while the second bracket 14*a* will face a second side surface 10*b*, opposite to the first side surface 10*a*, of bulkhead 10.

Joint 16, as previously mentioned, exerts a tightening action between the two brackets 12*a*, 14*a*, which rigidly retains bulkhead 10 between said brackets. Joint 16 may be made by coupling a countersunk screw 16*a* to a nut 16*b*, possibly with the interposition of a washer 16*c* between the nut and the subframe.

Figure 8:
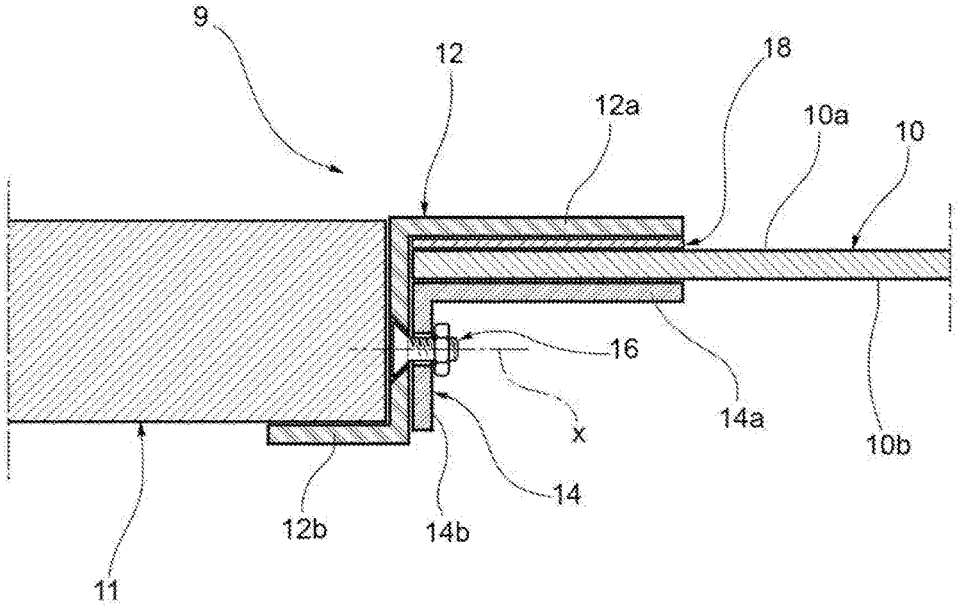
FIG. 8 is a diagrammatic cross-sectional view of a fastening assembly according to an embodiment of the present invention.

FIG. 8 shows an embodiment of a fastening assembly 9 of door 11 to bulkhead 10, according to the present invention. Also in this case, frame 12 and subframe 14 (which form the fastening assembly 9) have two brackets 12*a*, 14*a* at least partly facing and parallel to bulkhead 10, said brackets being separated by a first transverse distance A set to limit, without clasping, the bulkhead 10. Said distance A may be substantially equal to or greater than the thickness of bulkhead 10; optionally, there may be a clearance between the bulkhead and the frame/subframe, so as to facilitate the mutual movement between the parts and further decrease the friction.

However, between the portions of such brackets 12*a*, 14*a* which face the first side surface 10*a* and second side surface 10*b*, respectively, there are no junctions nor connecting elements, adapted to transmit a tightening force between the two brackets. Moreover, the joint does not engage nor perforate the bulkhead, thus avoiding unwanted tensions from being generated and effectively decoupling the bulkhead from the frame, as already said. In the example shown herein, the joints 16 are arranged so as to have longitudinal axis x parallel to bulkhead 10; a connection of the above-described type may be made by mutually constraining at least one primary flange 12*b* and at least one secondary flange 14*b*, forming part of frame 12 and subframe 14, respectively, by means of the aforesaid joints 16, said flanges being mechanically connected to said first and second brackets 12*a*, 14*a*. Joint 16 may be provided with an anti-unscrewing system in order to avoid the risk of disassembly during the ship operation.

Figure 14:
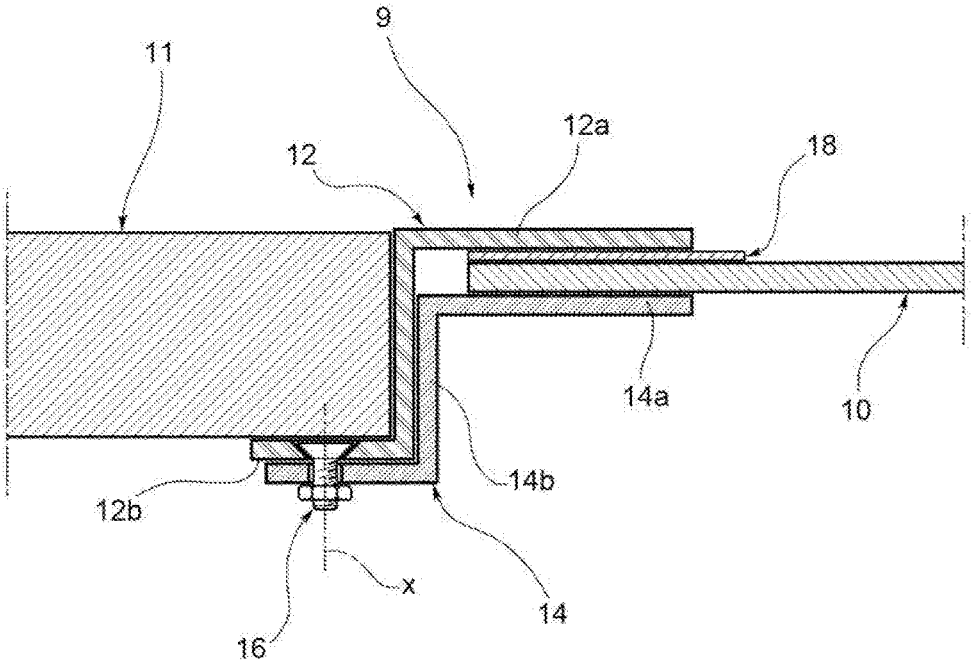
FIG. 14 is a diagrammatic cross-sectional view of a fastening assembly according to an embodiment of the present invention.
Figure 15:
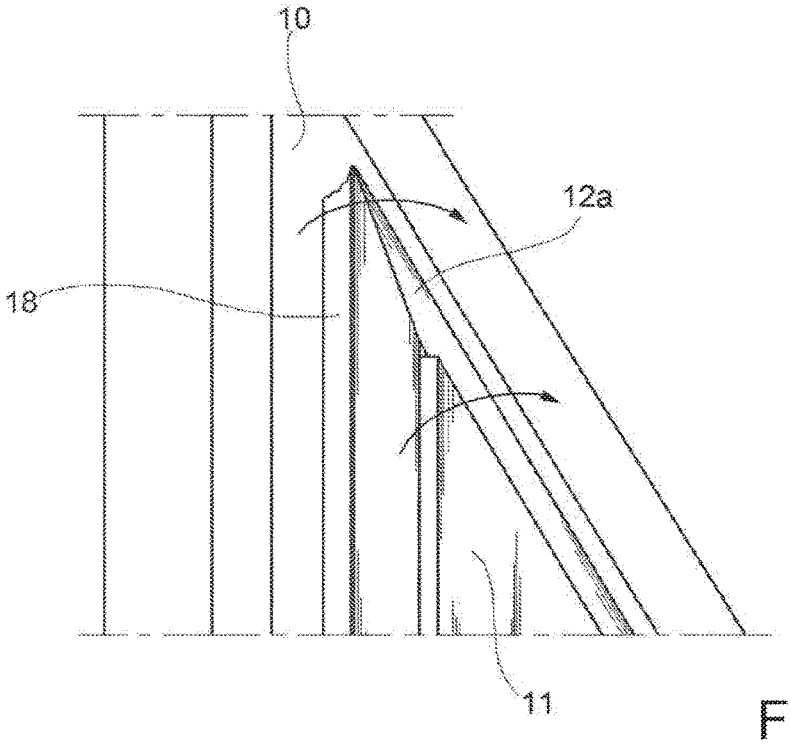
FIG. 15 is a diagrammatic perspective view of a feature of a fastening assembly subjected to deformation due to intense heat.
Figure 16:
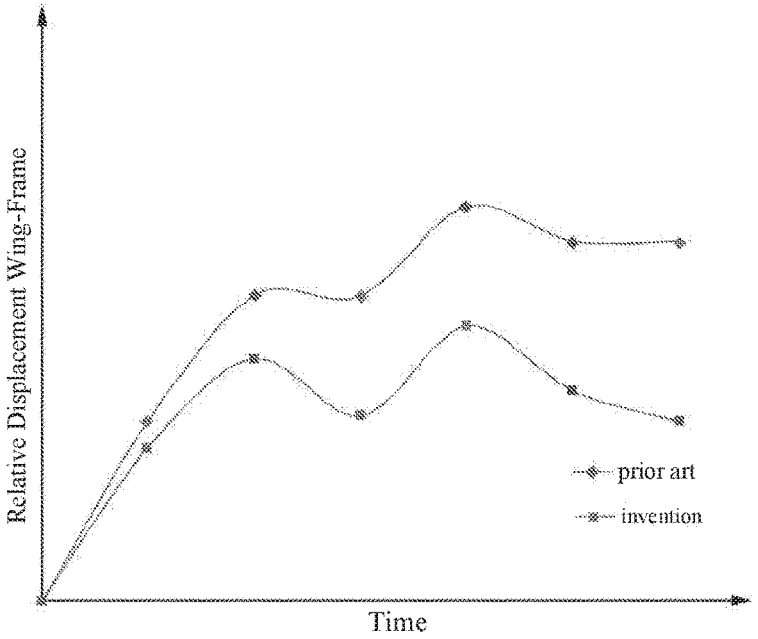
FIG. 16 is a comparative graph of the relative door-frame displacement, as a function of time, of a fastening assembly according to the prior art and of an assembly according to the invention, when the assembly is hit by intense heat.

The number and orientation of said primary and secondary flanges may be variable, as well as the orientation of the joints 16 which connect such flanges (see, for example, FIG. 14), as long as no coupling between the aforesaid portions of the brackets 12*a*, 14*a* facing the bulkhead 10 is achieved, such as to generate an exchange of forces between said portions of the brackets.

In any case, said flanges 12*b*, 14*b* must be mutually fastened so as to ensure, between the aforesaid portions of the brackets 12*a*, 14*a* facing the bulkhead 10, the first transverse distance A as predetermined, so that the fastening constraint of the door to the bulkhead is not of the rigid type, and since the tightening action is much lower with respect to the cases contemplated in the prior art, the stresses transmitted from the bulkhead to the frame will also be less harmful. In the example shown in FIG. 14, in order to ensure the correct extension of said distance A, the dimensional tolerances when manufacturing the various flanges 12*b*, 14*b* of the frame and the subframe should be particularly taken into account.

Frame 12, according to an embodiment (not shown), may consists of multiple juxtaposed frame segments or portions, rather than being monolithic as in the example shown herein.

Moreover, it may be made of extruded aluminum, and made heat-resistant by means of a frame top (not shown), made of steel for example.

Figure 10:
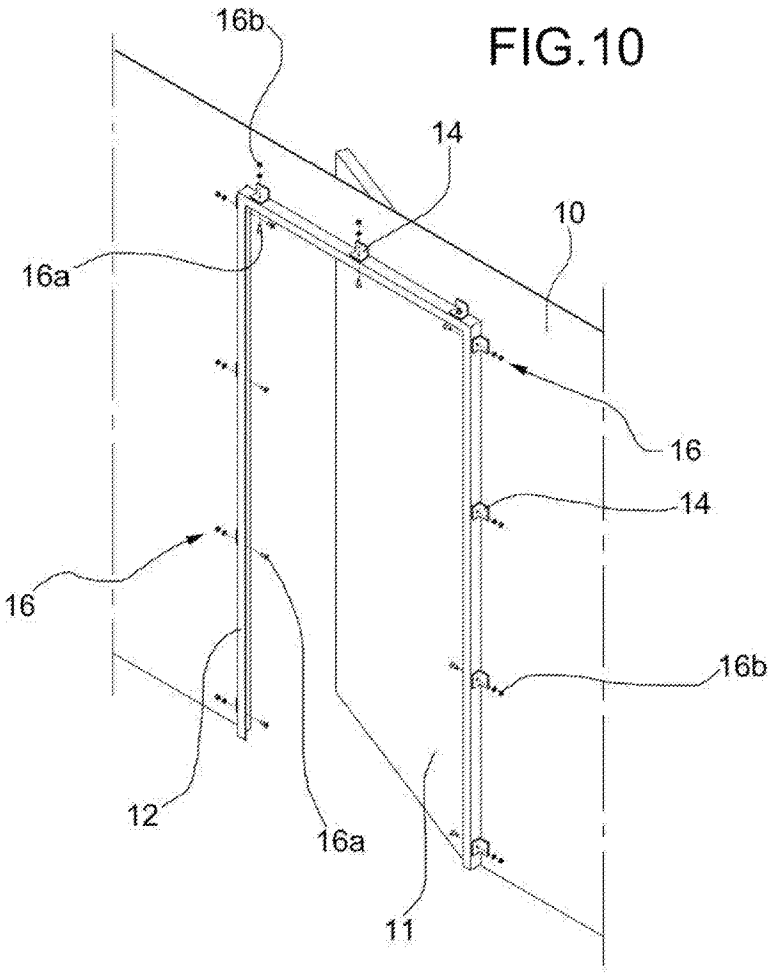
FIGS. 9 and 10 are diagrammatic, axonometric views, a front and a back view respectively, of a door mounted on a bulkhead, according to the embodiment of the invention in FIG. 9.
Figure 9:
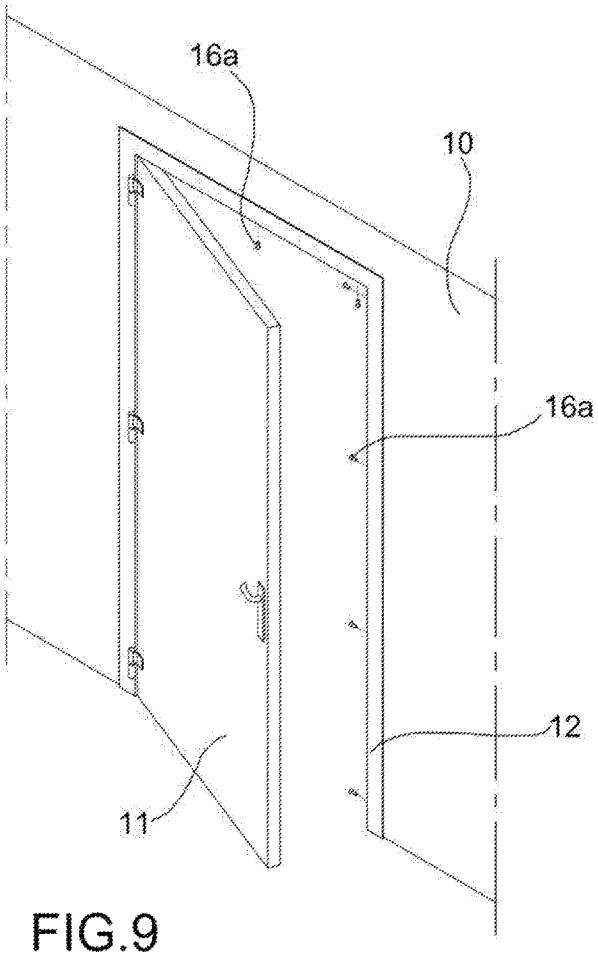
Figure 11:
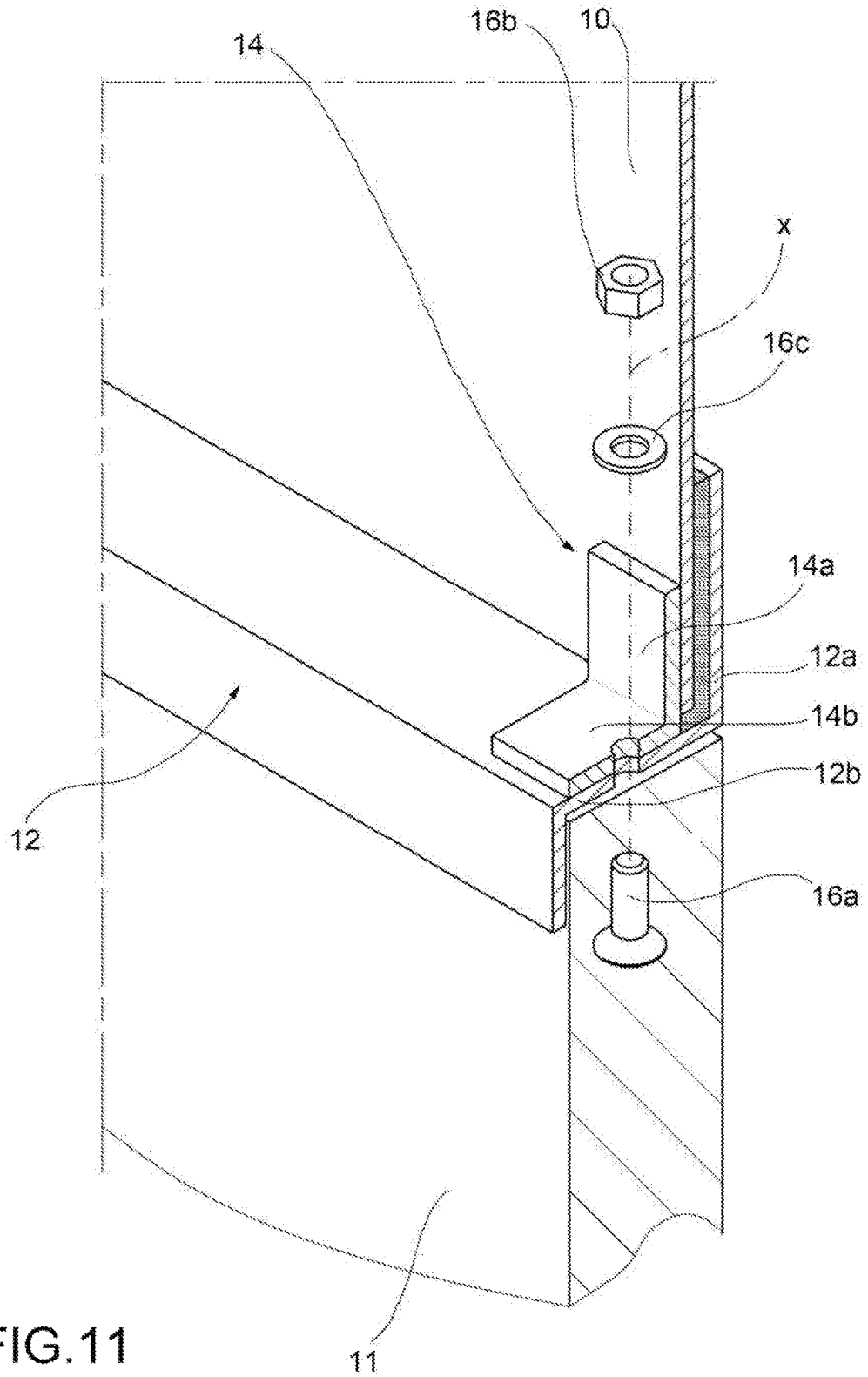
FIG. 11 is a diagrammatic sectional view of a detail of FIG. 10.

Subframe 14 (as seen in FIGS. 10 and 11) preferably comprises a plurality of plates spaced apart and bent at right angles, rather than being a single continuous extruded piece completely overlapping frame 12.

The joints 16, in place of the bolted joints depicted here, may be of the welded type, or may be interlocking systems, according to embodiments not shown.

Figure 12:
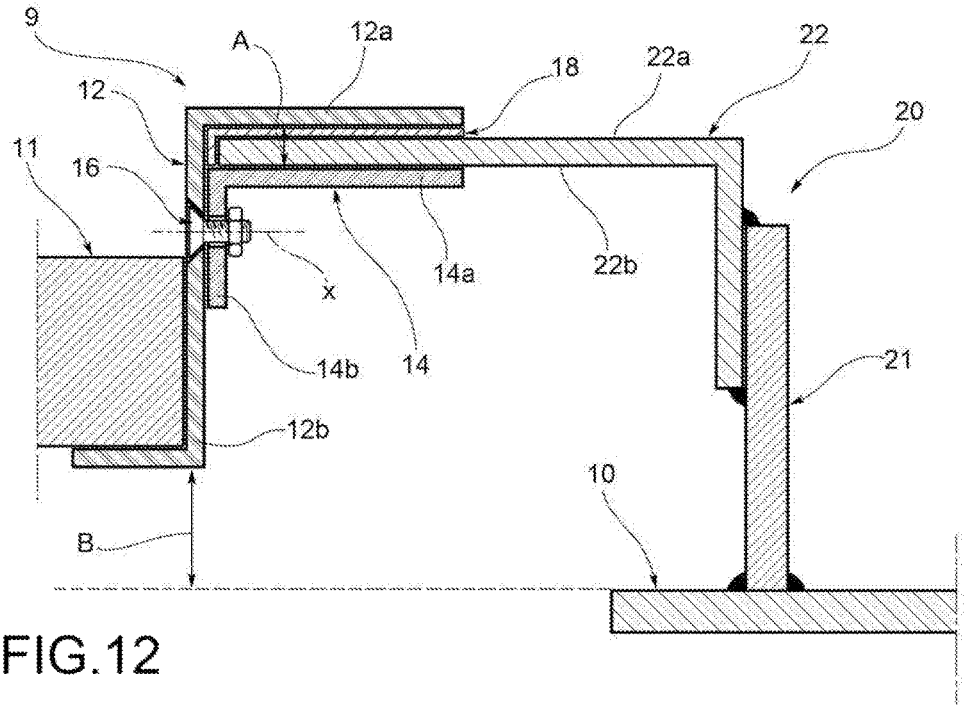
FIGS. 12 and 13 are diagrammatic cross-sectional views of two further embodiments of a fastening assembly according to the present invention.
Figure 13:
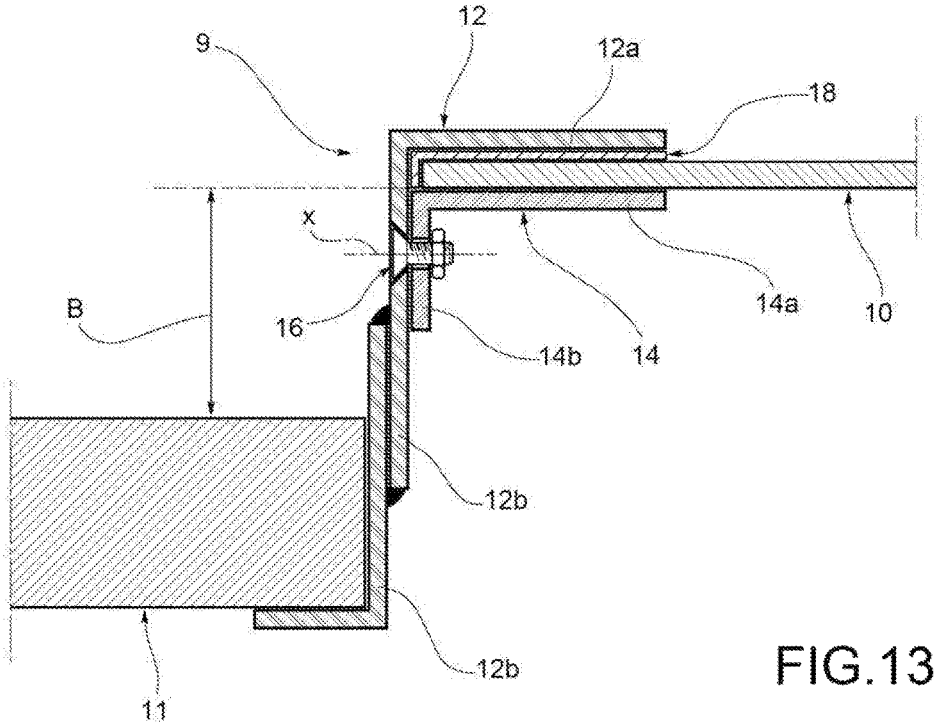

FIGS. 12 and 13 show two further embodiments of a fastening assembly according to the present invention, adapted to allow door 11 to be installed on a plane transversely spaced apart from bulkhead 10.

Throughout the present description and in the claims, the terms and expressions indicating positions and orientations, such as "longitudinal", "transverse", "vertical" or "horizontal", shall be referred to bulkhead 10.

In the example shown in FIG. 12, the fastening assembly including frame 12 and subframe 14 being facing, is similar to the previously described cases; in the example shown herein, the assembly 9 of frame 12 and subframe 14 is not directly connected to the bulkhead, but to a structure 20 comprising, according to an embodiment of the invention, a first and a second additional bracket 21, 22, conveniently welded together and rigidly connected to bulkhead 10. Such additional brackets 21, 22 may be variable in number, size and orientation, provided that the second additional bracket 22 is shaped and oriented so as to be received between the first 12*a* and second 14*a* of the brackets facing frame 12 and subframe 14; it is meant that, with regard to the features of said second additional bracket 22 and of the connection thereof to the fastening assembly 9, the same applies as previously said in connection with the modes of connecting assembly 9 to bulkhead 10.

The use of such a structure 20, as already mentioned, allows the door to be placed on a staggered plane with respect to bulkhead 10, while making the installation of door 11 on board of the vessel easier, since the structure and the door may be preassembled or retrofitted on the bulkhead. Therefore, the difference with respect to the previously discussed cases consists in that, in place of bulkhead 10, the first and the second brackets 12*a*, 14*a* of the fastening assembly will be connected to the structure 20, in place of the bulkhead 10 of the vessel.

Figure 5:
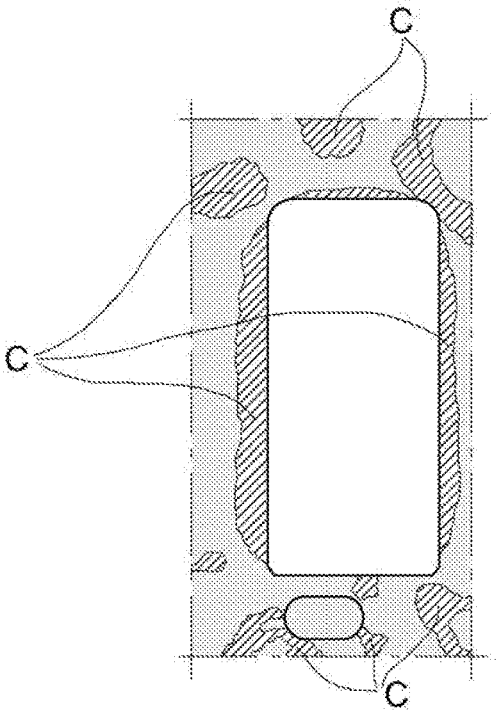

FIG. 13 shows an alternative embodiment, also adapted to space the bulkhead 10 from the leaf 11 of the door transversely. In this case, frame 12 comprises a certain number of the primary flanges 12*b*, mutually aligned and joined along a direction perpendicular to bulkhead 10, so as to increase or vary a second transverse distance B between the bulkhead and the leaf, when the latter is in the closed condition. Such primary flanges 12*b* may be mutually constrained, for example, by means of welding (as shown in FIG. 5).

Therefore, the second transverse distance B will depend on the number and/or extension in the transverse direction (with respect to the bulkhead 10) of such flanges 12*b*.

According to an embodiment of the invention, a sealing element 18 may be interposed between frame 12 (conveniently, at the portion of the first bracket 12*a* facing the bulkhead) and bulkhead 10, which sealing element 18 may comprise a sealing adhesive and a heat-expanding gasket. According to an embodiment (not shown), such a sealant 18 may be inserted between bulkhead 10 and subframe 14 (conveniently, at the portion of the second bracket 14*a* facing the bulkhead), alternatively or in addition to the sealant placed between frame 12 and bulkhead 10.

With respect to the prior art, in which the sealing element 18 is compressed between frame 12 and bulkhead 10, the possibility of having a certain clearance between said frame and bulkhead (for example, by broadening the distance A between the facing brackets 12*a*, 14*a*), increases the functions of the sealing element. In fact, the heat-expanding gasket, under critical conditions of temperature increase or fire, can freely increase its volume to occupy the entire clearance and ensure the sealing of the joint from the fumes or flames.

The sealing adhesive and heat-expanding gasket of the sealing element 18 synergistically work to meet the requirement of fume and flame resistance, required both in operation as well as for passing the standard fire test in accordance with the Fire Test Procedure of the International Maritime Organization (IMO).

In the first part of the test, i.e. until the connecting joint is at a temperature below 250° C., the sealing adhesive will ensure the joint resistance. For higher temperatures, the sealant could significantly deteriorate and no longer be able to fulfill its function, but for the purposes of the joint sealing, the heat-expanding gasket comes into operation, being able to work from about 200° C. up to the maximum temperatures which are reached at the end of the test. Ultimately, the combined use of sealant and heat-expanding gasket ensures the sealing of the joint, both when the door is mounted on board of the vessel, and for the whole duration of the standard fire test.

By way of example, adhesive materials used for sealing the joint may be silicone-based, even with flame-retardant properties, capable of reaching operating temperatures of up to 250° C. and withstanding temperature peaks of up to 300° C. for limited periods of time. Other adhesive sealants may be, for example:

mono and bi-component polyurethane-based, with flame-retardant properties, suitable to withstand maximum temperatures of up to 150° C.;

based on hybrid polymers, with flame-retardant properties, suitable to withstand maximum temperatures of up to 150° C.;

based on acrylic materials, with flame-retardant properties, suitable to withstand temperatures up to 150° C. and in some formulations with excellent flame reaction properties.

The materials used for manufacturing heat-expanding gaskets usually consist of graphite, or other mineral fibers, which ensure the resistance to high temperatures, and of small percentage amounts of organic materials used to give the system the intumescence function with temperature. Optionally, the sealing element 18 may be made, completely or in part, of an insulating material commercially known as Bifire®, the features of which are herein incorporated by reference.

As the fastening assembly 9, comprising frame 12 and subframe 14, is not rigidly connected to bulkhead 10 (or to the additional bracket 22 of structure 20), a high number of connecting joints between frame and subframe is not required, since the forces exchanged are not comparable to the case where such joints directly connect the frame to the bulkhead or to the subframe. Therefore, unlike the conventional solutions, which require a continuous welding over the whole periphery of the door or, for the bolted solutions, the drilling of several holes on the bulkhead (made of steel, aluminum alloy or other metal), in the present invention the mounting operation is easier and less burdensome given the lower number of joining points needed and the possibility of drilling the holes on the frame in the workshop, and not on the bulkhead on board of the ship.

Moreover, a fastening assembly of a door to a bulkhead according to the present invention allows the frame to be protected from the stresses transmitted by the wave load through the bulkhead, and therefore the occurrence of fatigue phenomena or other damages to the frame to be prevented, which phenomena may affect the structural integrity and/or the operational efficiency of the door.

Various aspects and embodiments of the fastening assembly according to the invention have been described. It is understood that each embodiment may be combined with any other embodiment. Moreover, the invention is not limited to the embodiments described, but may be varied within the scope defined by the appended claims.

The invention claimed is:

1. A fastening assembly of a fire door to a bulkhead, said bulkhead comprising a first side surface and a second side surface opposite to the first side surface; said assembly comprising:

a shaped frame, which the door is hinged to, the shaped frame includes:

a first bracket, at least partly facing the first side surface of said bulkhead; and at least one primary flange, mechanically connected to said first bracket;

a subframe comprising:

a second bracket, parallel to the first bracket and facing the second side surface of said bulkhead; and at least one secondary flange mechanically connected to said second bracket;

at least one joint, able to tighten the frame to the subframe to retain the bulkhead between said mutually facing first and second brackets;

wherein:

the at least one joint connects the at least one primary flange with the at least one secondary flange, avoiding engaging at the same time the portion of the first bracket facing the first side surface and the portion of the second bracket facing the second side surface, and avoiding directly engaging the bulkhead, the at least one joint being oriented along an axis parallel to said first and second brackets.

2. An assembly according to claim 1, wherein said first and second brackets are separated by a preset first transverse distance.

3. An assembly according to claim 1, wherein said primary and secondary flanges have a length, measured with respect to a direction perpendicular to the bulkhead, such that the door lies substantially on a same plane defined by said bulkhead.

4. An assembly according to claim 1, wherein the frame comprises a plurality of primary flanges substantially aligned along a direction perpendicular to the bulkhead, so that, by varying a number and/or extension of said flanges along said perpendicular direction, a second transverse distance, between the bulk-head and a closure plan of the door changes.

5. An assembly according to claim 1, wherein said assembly connects the door to a structure fixed perpendicular to the bulk-head.

6. An assembly according to claim 1, wherein between the first bracket and the bulkhead, and/or between the second bracket and the bulkhead, a sealing adhesive and a heat-expanding gasket are interposed.

7. An assembly according to claim 1, wherein the frame is a composite frame and is formed by a plurality of juxtaposed frame portions.

8. An assembly according to claim 1, wherein the fire door is made of a malleable material and has a yield stress greater than or equal to 230 MPa.

9. An assembly according to claim 8, wherein the material is S235, S275 or S355 structural steel.

10. A vessel, comprising at least one bulkhead and at least one fastener assembly of a fire door to the bulkhead, according to claim 1.

11. A method for fastening a fire door to a bulkhead, comprising the steps of:

a) providing a frame comprising a first bracket and at least one primary flange;

b) providing a subframe comprising a second bracket and at least one secondary flange;

c) arranging the frame so that the first bracket at least partly faces a first side surface of said bulkhead;

d) arranging the subframe so that the second bracket at least partly faces a second side surface of said bulkhead opposite to the first side surface;

e) providing at least one joint;

f) connecting, via the at least one joint, the at least one primary flange to the at least one secondary flange so that the joint avoids simultaneously engaging the portion of the first bracket facing the first side surface and the portion of the second bracket facing the second side surface of the bulkhead, and avoids directly engaging the bulkhead and so that the at least one joint is oriented along an axis parallel to said first and second brackets;

g) hinging the fire door to the frame.

12. A method according to claim 11, wherein step (f) is performed so that the portion of the first bracket, facing the first side surface, and the portion of the second bracket, facing the second side surface of the bulkhead, are separated by a preset first transverse distance.

13. A method according to claim 11, wherein step (f) is performed so that the door, when in a closed position, substantially lies on a same plane defined by the bulkhead.

14. A method according to claim 11, wherein step (f) is followed by the step of aligning, in a direction perpendicular to the bulkhead, and mutually joining a plurality of primary flanges, so as to vary a second transverse distance between the bulkhead and a plane on which the door lies when in a closed position.

15. A method according to claim 11, further comprising the step of providing a structure that includes at least a first additional bracket and at least a second additional bracket.

16. A method according to claim 15, comprising the step of securing the first additional bracket to the bulkhead and securing the second additional bracket to the first additional bracket, so that said second additional bracket is at least partly received between at least part of the first bracket and at least part of the second bracket and are mutually facing.

17. A method according to claim 11, further comprising the step of inserting between the portion of the first bracket facing the first side surface and the bulkhead, and/or between the portion of the second bracket facing the second side surface and the bulkhead, a sealing adhesive and a heat-expanding gasket.

18. A method according to claim 11, further comprising the step of composing the frame by juxtaposition of a plurality of frame portions.

19. A method according to claim 11, further comprising the step of providing the fire door in a malleable material which has a yield stress greater than or equal to 230 MPa.

20. An assembly according to claim 19, wherein the material is S235, S275 or S355 structural steel.

21. A method for securing a fire door to a bulkhead of a vessel, comprising the steps of claim 11.

* * * * *